United States Patent [19]

Geenen et al.

[11] 3,973,160

[45] Aug. 3, 1976

[54] COLOR SCREEN WITH SPACE BETWEEN LUMINESCENT REGIONS PERVIOUS TO THERMAL RADIATION FROM SHADOW MASK

[75] Inventors: Constant Joseph Maria Geenen, Kenya; Roelof Egbert Schuil, Eindhoven, both of Netherlands

[73] Assignee: U.S. Philips Corporation, New York, N.Y.

[22] Filed: Oct. 23, 1975

[21] Appl. No.: 625,121

Related U.S. Application Data

[63] Continuation of Ser. No. 493,777, Aug. 1, 1974, abandoned.

[30] Foreign Application Priority Data

Aug. 3, 1973 Netherlands ..... 7310738

[52] U.S. Cl. ..... 313/408; 313/470

[51] Int. Cl.[2] ..... H01J 29/30; H01J 29/07

[58] Field of Search ..... 313/466, 470, 403, 408, 313/471, 474

[56] References Cited

UNITED STATES PATENTS 3,146,368 8/1964 Fiore et al. ..... 313/408

*Primary Examiner*—Robert Segal

*Attorney, Agent, or Firm*—Frank R. Trifari; George B. Berka

[57] ABSTRACT

A shadow mask tube having phosphor regions with negative tolerance, and the intermediate spaces between the phosphor regions on the face plate being devoid of usual light-absorbing material and the aluminum layer.

1 Claim, 2 Drawing Figures

Figure 1:
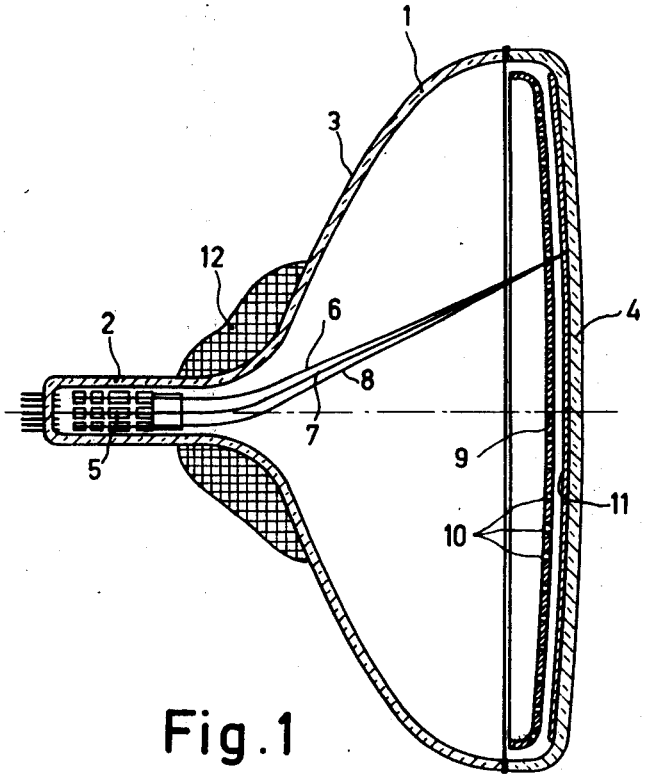

COLOR SCREEN WITH SPACE BETWEEN LUMINESCENT REGIONS PERVIOUS TO THERMAL RADIATION FROM SHADOW MASK

This is a continuation of application Ser. No. 493,777 filed Aug. 1, 1974 now abandoned.

The invention relates to a cathode ray tube for displaying colored pictures and comprising in an evacuated envelope which has a transparent face plate means to generate a number of electron beams, a display screen comprising a large number of regions which luminesce in different colors and are provided on said face plate and a color selection electrode which has a large number of apertures, said electron beams being each associated with luminescent regions of one color by means of the colour selection electrode, said luminescent regions being each smaller or narrower than the corresponding apertures in the color selection electrode.

Such a cathode ray tube is known from the U.S. Pat. No. 3,146,368. In this patent specification it is described that the ambient light which is reflected by the luminescent regions considerably reduces the contrast of the displayed picture. As a solution to this problem the said patent specification suggests to provide light-absorbing material between the luminescent regions and to cause the luminescent regions to be overlapped by the electron spots. The object of the last-mentioned measure is to be able to cover a comparatively large part of the display screen with light-absorbing material and this is referred to as negative tolerance in contrast with the positive tolerance in tubes in which the electron spots excites the luminescent regions only partly.

It is the object of the invention to provide a cathode ray tube for displaying colored pictures which is not provided with said light-absorbing material between the luminescent regions but in which spoiling of the contrast by reflected ambient light is prevented in a different manner.

According to the invention a cathode ray tube of the type mentioned in the first paragraph is characterized in that the regions of the face plate between the said luminescent regions are uncovered in such manner that radiation from and to the interior of the tube can pass via the face plate.

In a cathode ray tube according to the invention the ambient light which impinges upon the display screen between the luminescent regions is passed to the interior of the tube. At this area, at a short distance from the display screen, the color selection electrode is present which, in order to improve the thermal radiation, generally is blackened and thus also absorbs the passed ambient light. An extra advantage of a tube according to the invention is that a part of the thermal energy radiated by the colour selection electrode in the direction of the display screen is not reflected by the thin aluminum layer with which the whole display screen is covered in known tubes. This part of the radiated thermal energy can leave the tube via the face plate so that the temperature of the colour selection electrode is reduced which of course is a great advantage in connection with the deformation of the colour selection electrode determined by temperature influences which may cause colour defects. In a tube according to the invention the said thin aluminum layer only covers the luminescent regions themselves.

Figure 2:
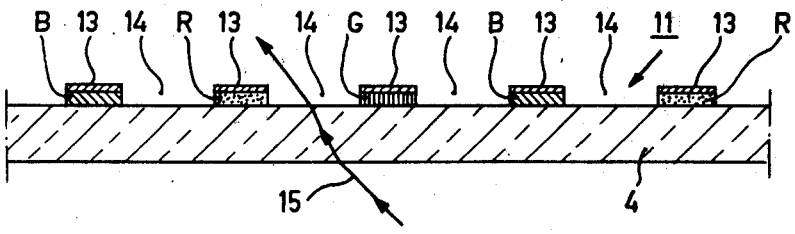

The inventon will be described in greater detail with reference to the accompanying drawing, of which FIG. 1 is a cathode ray tube for displaying coloured pictures according to the invention and FIG. 2 shows a part of the display screen of the tube shown in FIG. 1.

The cathode ray tube for displaying coloured pictures shown in FIG. 1 is a so-called shadow mask tube. The tube comprises in an evacuated glass envelope 1 which consists of a neck portion 2, a cone portion 3 and a face plate 4, means 5 to generate three electron beams 6, 7 and 8, a shadow mask 9 (color selection electrode) having a large number of apertures 10, and a display screen 11. The tube futhermore has a set of deflection coils 12 for scanning the display screen 11 by means of the electron beams 6, 7 and 8. The display screen 11 consists of a large number of triplets of phosphor regions luminescing in red, blue and green, respectively. The apertures 10 in the shadow mask 9 select the electron beams 6, 7, 8 in known manner so that the electron beam 6 only impinges upon red luminescing phosphor regions and the electron beams 7 and 8 only on green and blue luminescing phosphor regions, respectively. The phosphor regions are arranged in a suitable pattern, for example, parallel strips. The tube has negative tolerance which means that the electron spots overlap the phosphor regions.

FIG. 2 shows a part of the face plate 4 and the display screen 11 on a considerably enlarged scale. A triplet consists of a red luminescing phosphor strip R and green and blue luminescing phosphor strips G and B, respectively. The phosphor strips R, G and B are covered with a thin aluminium layer 13 which is permeable to electrons and one of the objects of which is to reflect the light emitted by the phosphors in the direction of the viewer. The strip-shaped parts of the aluminium layer 13 which cover the phosphor strips are interconnected at their ends along the edge of the display screen 11 via the part of the aluminium layer which is present on the upright edge of the face plate 4. This is necessary because the phosphor strips might otherwise be charged under the infuence of the electron beams. In the intermediate spaces 14 between the phosphor strips R, G and B the face plate is uncovered. As a result of this a large part, more than 50%, of the ambient light 15 can penetrate via the face plate 4 into the interior of the envelope 1 where it is absorbed, for example, by the shadow mask 9. This ambient light is not absorbed, as in known tubes, by light-absorbing material in the intermdiate spaces 14. The absence of light-absorbing material on the face plate 4 moreover increases the luminous efficiency of the tube because this material in known tubes proves to absorb approximately 15% of the light emitted by the phosphors. Moreover, in a tube according to the invention, a large part of the thermal energy radiated by the shadow mask 9 in the direction of the display screen 4 can leave the tube so that the shadow mask obtains a lower operating temperature and fewer colour defects occur.

A display screen as shown in FIG. 2 may be manufactured as follows. First a display screen comprising red, green and blue luminescing phosphor regions is provided in known manner on the face plate 4. Said display screen is then aluminium-plated, also in known manner, so that the aluminium layer 13 also extends over the intermediate spaces 14. A photosensitive layer consisting of polyvinyl alcohol sensitized with ammonium bichromate is then provided across the aluminium layer. Said layer is exposed in known manner three times via the shadow mask 9 as a result of which the polyvinyl alcohol becomes insoluble in the exposed regions which coincide with the phosphor strips R, G and B. Moreover, an extra exposure is carried out of the edge around the display screen 11 as a result of which the polyvinyl alcohol becomes insoluble also at the area of said edge. The photosensitive layer is then developed by rinsing with water so that the polyvinyl alcohol in the intermediate spaces 14 is dissolved. The aluminum layer is then treated with an etchant so that the aluminium layer in the intermediate spaces 14 is etched away but remains present at the area of the phosphor strips R, G and B and along the edge of the display screen 11 due to the protection of the polyvinyl alcohol still present at that area. After rinsing, drying and firing of the organic materials still present, the display screen shown in FIG. 2 is obtained. An etching liquid suitable for aluminium is, for example, an aqueous solution of $NH_4Cl$ and $H_gCl_2$ having a pH of at least 2. The aluminum layer in the intermediate spaces 14 changes into $AlCl_3$ and AlOOH.

If the display screen 11 is provided with a black border which consists of an electrically conductive light-absorbing material, for example graphite, the said extra exposure of the edge may be omitted because the aluminium strips are then connected via said frame.

It is also possible to use for the selective etching of the aluminium layer a photosensitive layer which, by exposure, turns from water-insoluble into water-soluble. For this purpose may be used, for example, polyvinyl alcohol sensitized with ferrichloride ($FeCl_3$). Said photosensitive layer should then be exposed via the shadow mask 9 in the regions which coincide with the intermediate spaces 14. An exposure of the edge of the display screen 1 may then be omitted. After development by rinsing with water the whole aluminium layer is covered with polyvinyl alcohol with the exception of the intermediate spaces 14. The aluminium layer is then etched away at the area of the intermediate spaces 14 in the manner already described.

What is claimed is:

1. A color cathode ray tube comprising, in an evacuated envelope having a transparent face plate, means to generate a number of electron beams; a color selection electrode located opposite said face plate and having a plurality of apertures, a display screen provided on said face plate and including a plurality of discrete regions which luminesce at different colors, said electron beams being each associated with the luminescent regions of one color through the assigned apertures of said color selection electrode, said luminescent regions being each smaller or narrower than the corresponding apertures and individually covered with electron permeable, light reflecting metal, and the regions of the face plate between said luminescent regions being pervious to ambient light and thermal radiation, said color selection electrode being treated for improved thermal radiation and ambient light absorption.

* * * * *